US008567539B2

(12) United States Patent
Morath et al.

(10) Patent No.: US 8,567,539 B2
(45) Date of Patent: Oct. 29, 2013

(54) DRIVING DEVICE FOR A CRANE

(75) Inventors: Erwin Morath, Ehingen-Lauterach (DE); Mikica Rafailovic, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 13/559,049

(22) Filed: Jul. 26, 2012

(65) Prior Publication Data

US 2013/0025948 A1 Jan. 31, 2013

(30) Foreign Application Priority Data

Jul. 29, 2011 (DE) ..... 10 2011 108 893

(51) Int. Cl.
*B66C 23/40* (2006.01)

(52) U.S. Cl.
USPC ..... 180/53.1; 180/53.8

(58) Field of Classification Search
USPC ..... 180/53.1–53.6, 69.6; 219/133, 134; 137/899.4
See application file for complete search history.

(56) References Cited

U.S. PATENT DOCUMENTS

| | | | | |
|---|---|---|---|---|
| 1,771,333 | A | 7/1930 | Joret | |
| 5,957,235 | A | 9/1999 | Nishimura et al. | |
| 6,276,449 | B1 | 8/2001 | Newman | |
| 6,308,441 | B1 | 10/2001 | Bolitho | |
| 8,336,650 | B2 * | 12/2012 | Wernicke et al. | 180/53.4 |
| 2006/0107920 | A1 * | 5/2006 | Serkh et al. | 123/198 R |
| 2008/0122195 | A1 * | 5/2008 | Beeson et al. | 280/151 |
| 2009/0218327 | A1 | 9/2009 | Beeson | |
| 2010/0051570 | A1 | 3/2010 | Wernicke et al. | |

FOREIGN PATENT DOCUMENTS

| | | | |
|---|---|---|---|
| DE | 102010022601 | A1 | 10/2011 |
| EP | 1752411 | A1 | 2/2007 |
| JP | 9278371 | A | 10/1997 |
| JP | 2002276401 | A | 9/2002 |
| WO | 2007043924 | A1 | 4/2007 |
| WO | 2010130284 | A1 | 11/2010 |

OTHER PUBLICATIONS

European Patent Office, European Search Report of EP12005211.3, Jul. 11, 2013, Netherlands, 6 pages.

* cited by examiner

*Primary Examiner* — Drew Brown
(74) *Attorney, Agent, or Firm* — Alleman Hall McCoy Russell & Tuttle LLP

(57) ABSTRACT

The present disclosure relates to a driving device for a crane, wherein the crane includes an undercarriage and an uppercarriage, with at least one undercarriage engine arranged in the undercarriage, which is an internal combustion engine, and with at least one uppercarriage drive, wherein the uppercarriage drive can be driven by means of a torque and/or power transmission device to be driven by the undercarriage engine. Furthermore, the present disclosure relates to a crane with such driving device.

20 Claims, 4 Drawing Sheets

DRIVING DEVICE FOR A CRANE

CROSS REFERENCE TO RELATED APPLICATION

This application claims priority to German Patent Application No. 10 2011 108 893.1, entitled "Driving Device for a Crane," filed Jul. 29, 2011, which is hereby incorporated in its entirety by reference for all purposes.

TECHNICAL FIELD

The present disclosure relates to a driving device for a crane, wherein the crane includes an undercarriage and an uppercarriage, and to a crane.

BACKGROUND AND SUMMARY

Large cranes frequently include a large undercarriage engine and a small uppercarriage engine.

It should be noted that, in crane construction, attempts have been made for many years to optimize the weight distribution and hence to increase the load capacity of cranes. Since the admissible axle load of maximally 12 tons in public road traffic is specified, no more leap in performance is to be expected. A crane with 5 axles, for example, can be traveled on the road with a maximum total load of 60 tons. Thus, the performance of a crane with 5 axles is about the same with all crane manufacturers.

The crane uppercarriage is rotatably mounted about a vertical axis of rotation around the undercarriage. Around the axis of rotation, a rotary union generally is mounted, which represents a connection between the uppercarriage and undercarriage. This connection, for example, can be of the hydraulic or electrical type.

An internal combustion engine has its highest performance at its maximum speed and can be operated in this range.

Alternatively, a larger and hence more powerful engine might also be used. This engine might then be operated with a lower speed. Thus, in crane operation the engine would not have to be operated in the performance-optimized range, but might also be operated in the consumption-optimized range. On the other hand, there is the additional weight.

This is to be set against a higher fuel consumption of a larger internal combustion engine. Each cylinder of an engine has friction losses, churning losses, etc.

Furthermore, mobile cranes in a single-engine configuration are known. These cranes have an engine in the undercarriage and supply the uppercarriage with energy via a so-called "hydraulic shaft." Via the rotary union hydraulic oil is passed into the uppercarriage, which then directly or indirectly supplies the respective crane actuators. However, this is expensive.

Therefore, it is the object of the present disclosure to develop a driving device for a crane as mentioned above in an advantageous way.

In accordance with the present disclosure, this object is solved by a driving device for a crane, wherein the crane includes an undercarriage and an uppercarriage, is provided with at least one undercarriage engine arranged in the undercarriage, which is an internal combustion engine, and with at least one uppercarriage drive, wherein the uppercarriage drive can be driven by a torque and/or power transmission device to be driven by the undercarriage engine.

This provides the great advantage that the internal combustion engine in the undercarriage, which is dimensioned large in terms of performance for the driving operation of the crane on the road, also can be utilized for the uppercarriage drive. Thus, the "smaller" engine, i.e. the uppercarriage engine, can be omitted from the crane drive in some embodiments. The weight advantage resulting therefrom can be invested into the crane lifting power and/or into the stability of various assemblies.

Thus, by selectively omitting a regularly used and heavy component, a performance leap can be achieved in crane construction, which means that a crane with distinctly improved performance data can be provided. Omitting the uppercarriage engine with its heavy assemblies such as engine, oil and fuel tank, etc. leads to the fact that the aim of weight reduction with a simultaneous increase in performance can be achieved particularly advantageously.

The torque and/or power transmission device is a mechanical torque and/or power transmitting device and in particular serves for the mechanical transmission of forces, torque and power from the undercarriage engine to the crane actuators arranged in the uppercarriage, which are driven or drivable by the uppercarriage drive.

Furthermore, there is the advantage that it is now sufficient to certify only one engine, namely the undercarriage engine in some embodiments, in particular in terms of exhaust gas, noise, etc. In addition, it is advantageous that the maintenance for merely one engine, namely the undercarriage engine, must be made, so that the maintenance effort is reduced. The availability advantageously is increased, since there are less components which can fail.

Furthermore, it can be provided that the torque and/or power transmission device is and/or comprises at least one articulated shaft, in particular a vertical shaft.

It is also possible that the torque and/or power transmission device is and/or comprises at least one angular transmission.

In addition, it is conceivable that the torque and/or power transmission device includes at least one clutch, by which the uppercarriage drive can be engaged and disengaged, wherein the clutch is optionally arranged in the undercarriage or in the region of the undercarriage.

Furthermore, it can be provided that the torque and/or power transmission device can be driven directly by an auxiliary drive of the undercarriage engine and/or that the torque and/or power transmission device can be driven by an auxiliary drive of a manual or automatic transmission and/or that the torque and/or power transmission device can be driven by an auxiliary drive of a transfer gear.

It is furthermore conceivable that the uppercarriage drive comprises at least one pump transfer gear.

It is possible that the torque, force and power transmission from the undercarriage engine to the uppercarriage drive is effected exclusively mechanically.

In addition, it can be provided that the undercarriage engine is a powerful and large-size internal combustion engine, in particular a diesel engine, wherein the power of the undercarriage engine is dimensioned such that the power required for the crane operation can be provided by the undercarriage engine at a low engine speed, in particular in a speed range above the idling speed to about twice the idling speed, for example up to a range of within 10% of twice idle speed.

It is possible that on the uppercarriage or in the region (region A) of the uppercarriage an auxiliary engine is provided, by which the uppercarriage drive can be driven.

Furthermore, the present disclosure relates to a crane with the above features or other features described herein, for example, wherein the crane may be a mobile crane, in particular a large mobile crane.

Further details of the present disclosure will now be explained in detail with reference to an exemplary embodiment illustrated in the drawing.

DETAILED DESCRIPTION

Figure 1:
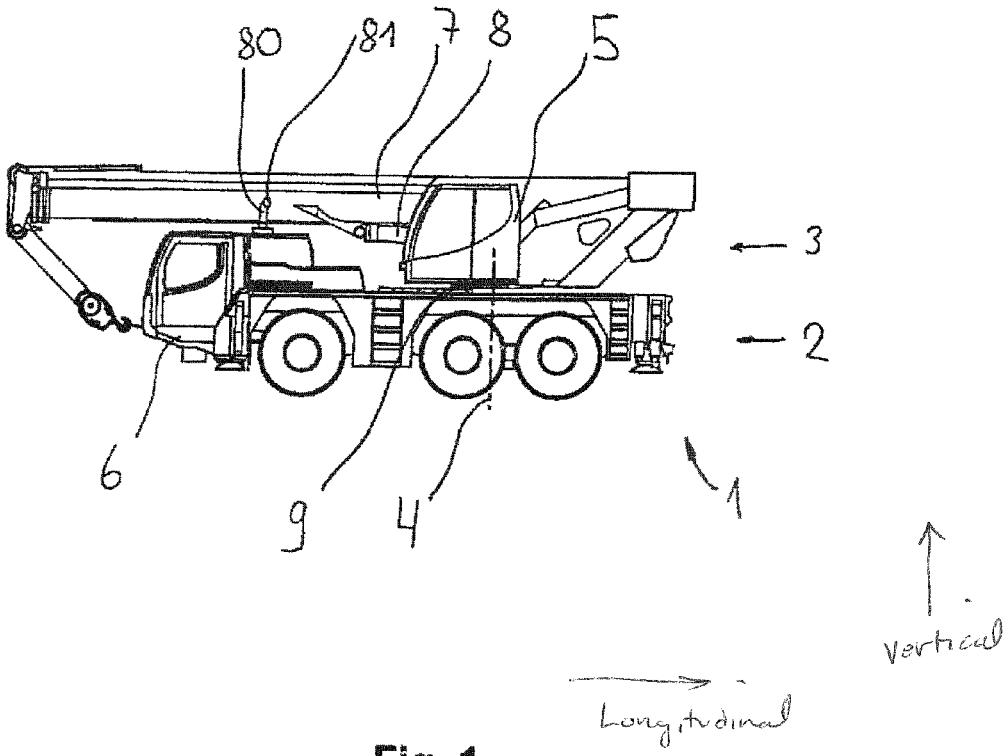
FIG. 1 shows a schematic side view of a crane.

FIG. 1 shows a schematic side view of a crane 1 with a driving device according to the present disclosure. The crane 1 is a mobile crane 1.

Figure 2:
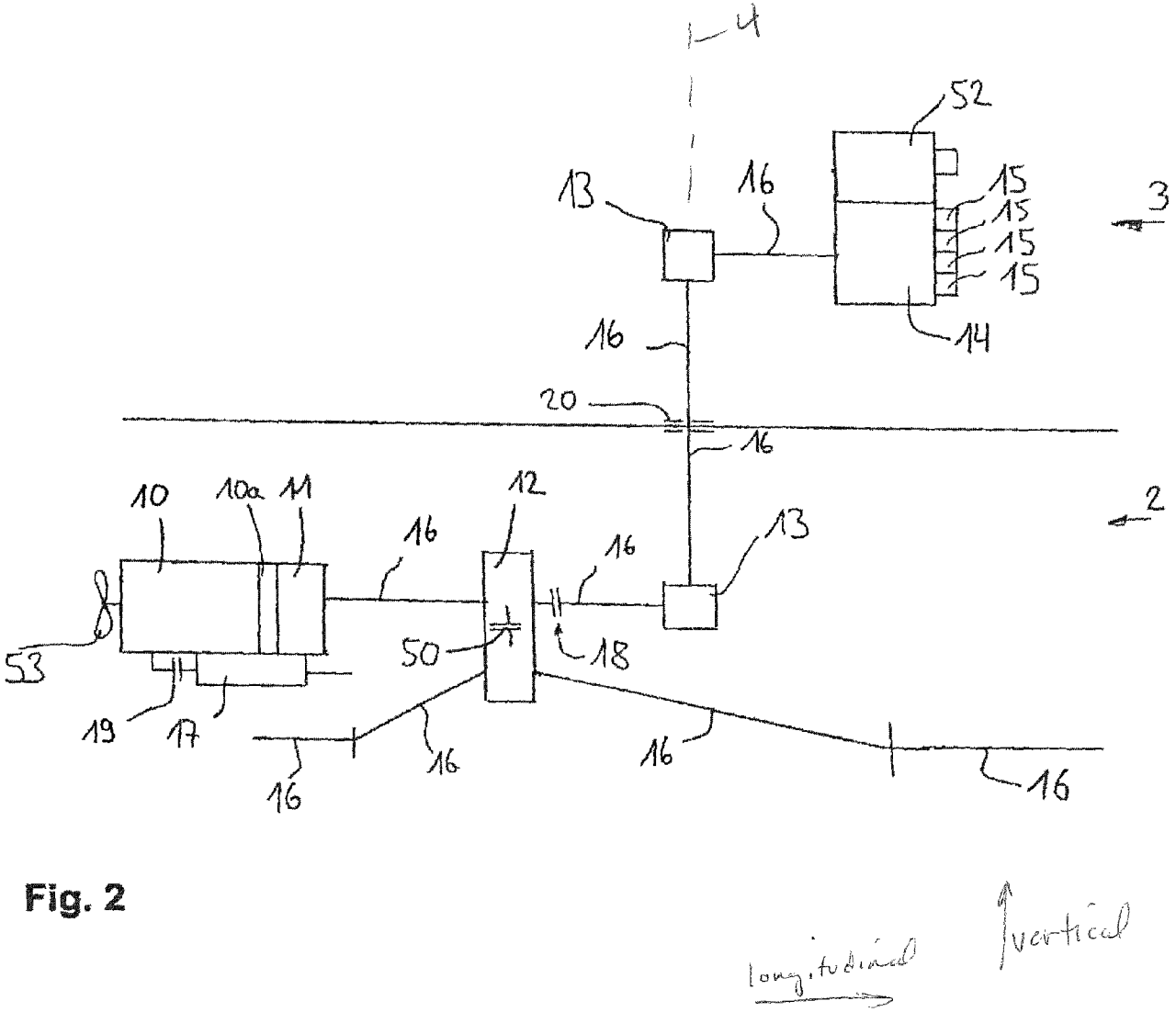
FIG. 2 shows a schematic view of a driving device according to the present disclosure in a first embodiment.

FIG. 2 furthermore shows a schematic view of the driving device according to the present disclosure in a first embodiment.

According to the present disclosure, the drive to the uppercarriage 3 of the crane 1 is effected via articulated shafts 16 up to the slewing ring center, the axis of rotation 4. An angular transmission 13, which is designed with a 90° angle, is centrally inserted in the vehicle frame and the drive is passed on to the uppercarriage 3. In the uppercarriage 3, a further angular transmission 13 is realized with power transfer to a pump transfer gear 14. If necessary, a suitable position of the pump transfer gear 14 can also be reached by a further non-illustrated angular transmission 13. It should be noted that in the uppercarriage 3, the boom 7 and the luffing cylinder 8 occupy the region of the slewing center and around the longitudinal axis. Thus, a further angular transmission 13 may become necessary, in order to come out of this region.

The uppercarriage drive can be branched off from the existing and known drive train in various ways, namely directly from an auxiliary drive 10*a* of this diesel engine 10, by bypassing the transmission;

from an auxiliary drive at the manual or automatic transmission 11; or at an auxiliary drive from a transfer gear 12, wherein the shaft optimally is simply passed directly through the transfer gear 12.

Since a further objective of the present disclosure is the saving of fuel, it is very advantageous that, independent of where it is located, the uppercarriage drive can be switched off, for example, via a clutch 18. Furthermore, a clutch 50 is provided in the undercarriage 2, which actively uncouples the undercarriage drive close to the branching point for the uppercarriage drive and thus lowers the friction losses.

The gear ratio of the uppercarriage drive can be chosen freely, as required. When arranged on the transfer gear 12, the gear ratio can be determined as required in dependence on the gear stage. However, an optimum gear ratio to the diesel engine 10 may be determined. This gear ratio can either be equal to the engine speed or be increased to the fast mode. The same applies to the angular transmissions 13, which can either have a gear ratio of 1:1 or a step-up to the fast mode.

Understandably, a torque and a power are transmitted for the uppercarriage drive. This torque effects a disturbing torque on the uppercarriage 3. If this moment is above the friction losses of the roller-bearing slewing ring 9, further measures must be provided. Thus, the necessary supporting moment can be calculated by the controller and then suitably be compensated by the slewing gear.

The large-size undercarriage engine 10 has sufficient power for crane operation. In terms of power, it is designed for driving operation. As regards the maximum power, the uppercarriage engine so far have had to be chosen as smaller, as this would provide both weight and cost savings. These savings, however, involved a disadvantage of the operation in the higher speed range, which resulted in a higher fuel consumption. In the uppercarriage operation, the undercarriage engine 10 can thus be operated in a consumption-optimized range with a reduced speed. Note that the large-size undercarriage engine 10 is large as compared to the smaller diesel engine located in the uppercarriage.

For crane operation it is important to operate the diesel engine 10 in the optimum fuel consumption map. In a power comparison of the required power as compared to the provided power, the engine speed is associated correspondingly, so that the engine is operated in the optimum fuel consumption map.

Another problem when using only one diesel engine 10 is the exhaust gas routing. The undercarriage 2 is stationary and the uppercarriage 3 rotates about the axis of rotation 4. Depending on the lifting task, the uppercarriage 3 and hence the crane cabin 5 can take a position in a 360° circle. To ensure that, even with an unfavorable position of the uppercarriage 3 and with unfavorable wind conditions, the exhaust gases do not immediately get into the crane cabin 5, the exhaust gas routing is designed in a suitable way. This can be solved by moving forward exhaust gases from the muffler 80 are to the operator cabin 6 as far as possible and, in addition, the exhaust gas exit 81 is realized upwards and to the side, respectively.

Furthermore, it should be mentioned that the hydraulic rotary union often used so far can be omitted. The energy is transmitted mechanically or substantially mechanically. Only a small slip ring 20 is necessary for transmitting the electrical signals and energy.

To further save fuel, it is advantageous to design the pumps 17 for the auxiliary load in the undercarriage 2 such that they can also selectively be uncoupled via a clutch 19. This clutch must, however, also be switchable selectively, so as to be able to provide, for example, a driving operation from the uppercarriage 3 (e.g. crab steering). According to the prior art, the pumps 17 were not switchable.

Figure 3:
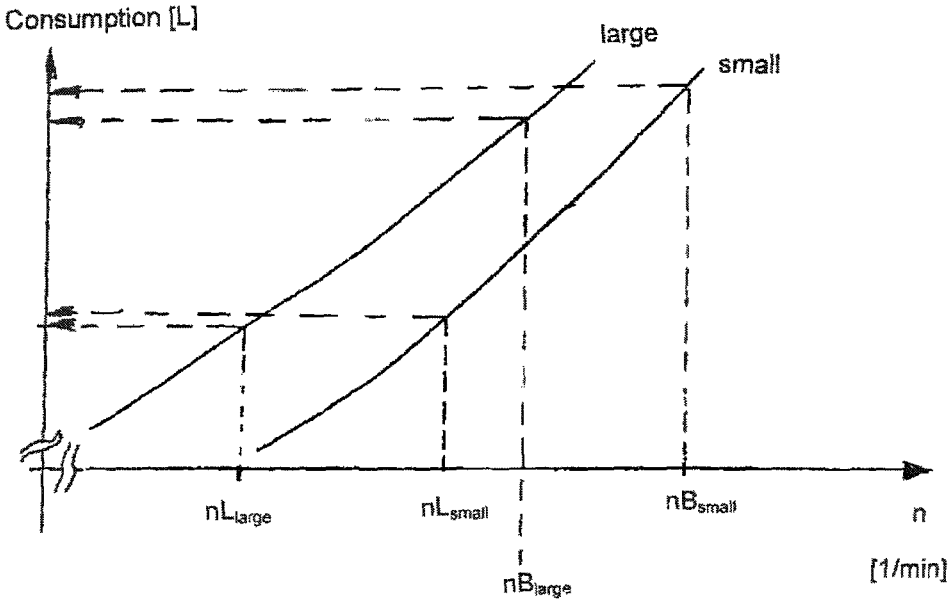
FIG. 3 shows a diagram concerning the comparison of the consumption characteristics of a large and small internal combustion engine.

A further aspect for fuel saving can be seen from FIG. 3, with illustration of the consumption characteristics of a large and a small engine. This diagram is a simplified representation of the speed-dependent fuel consumption of an internal combustion engine. The large diesel engine 10 can be operated at a low idling speed nLlarge. The previous small diesel engine had to be operated at a higher idling speed nLsmall. Furthermore, a fuel saving can be achieved from the low operating speed nBlarge as compared to the higher—previously explained—operating speed nBsmall.

The efficiency of each angular transmission 13 is about 0.99 to 0.98. Thus, sufficient power still is available at the pump transfer gear 14 in the uppercarriage 3. Also shown are pumps 15 coupled to the pump transfer gear 14, which may include hydraulic pumps coupled to hydraulic actuation systems of crane elements.

A further positive aspect is the reduced generation of noise, since the diesel engine 10 is operated at a low speed. This aspect also can influence the fuel consumption. Since the diesel engine 10 is dimensioned very large, it can be operated with low speed and correspondingly generates little heat. Thus, the fans 53 for the engine cooling can be operated with low speed or even not be operated at all.

When considering the typical crane operation, it can now be noted that the diesel engine 10 in general has been operated in idle mode for more than 50% of its time—also previously. For example, this is due to the fact that the diesel engine 10 was required for the air-conditioning system of the crane cabin 5. Moreover, the crane operator could not shut off the diesel engine 10.

Figure 4:
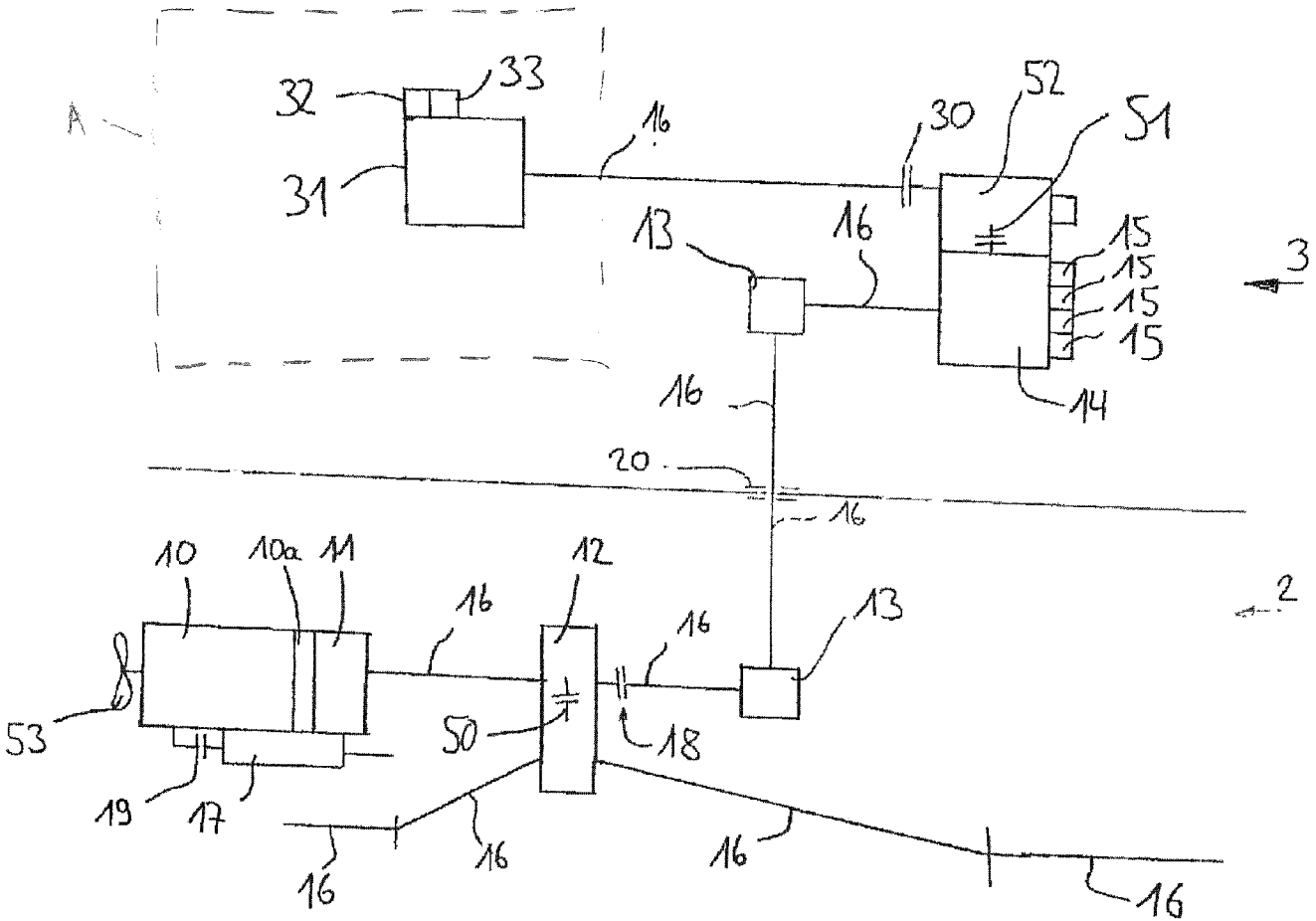
FIG. 4 shows a schematic view of the driving device according to the present disclosure in a further embodiment.

As seen in FIG. 4, according to a further aspect of the present disclosure, an auxiliary engine 31 can be provided at the uppercarriage 3. The auxiliary engine 31 can be designed of variable size. This auxiliary engine 31 can include a starter 33 and a generator 32. During the standby time, the generator 32 might take over the supply of the electric loads, such as for illumination. During the night, if the crane remains erected with a boom height of more than 100 m, this auxiliary engine 31 also can operate the flight warning light. Via a separable clutch 30, the air conditioning system 52 or a preheating of selected components thus might also be operated by the auxiliary engine 31. In the case of a failure of the diesel engine 10, an emergency operation might be effected via an articulated shaft 16 to the pump transfer gear 14. This connection of course also includes a separable clutch 51. In the case of a failure of the battery in the undercarriage 2, the auxiliary engine 31 also might be used for charging purposes.

Of course, the auxiliary engine 31 also might be a unit separate from the uppercarriage 3.

Another embodiment not shown in detail in the drawings preferably relates to large cranes, in which the distance between the internal combustion engine and the rotary lead-through is very large. Here, a solution, as shown in FIG. 2, would lead to a very long drive shaft 12 up to the angular transmission 13. In this case of application, the drive shafts 16 of the axles also can alternatively be used. The angular transmission 13 (cf. FIG. 2) thus can be driven by an output shaft which is branched off at an axle drive. In this solution, a clutch may be provided at each axle, so that the respective axle can be uncoupled from the drive train, in order to prevent the wheels from also rotating during the crane operation.

The invention claimed is:

1. A driving device for a crane, comprising: an undercarriage and an uppercarriage, with at least one undercarriage engine arranged in the undercarriage, which is an internal combustion engine, and with at least one uppercarriage drive, wherein the uppercarriage drive is driven by a mechanical torque and/or power transmission device driven by the undercarriage engine.

2. The driving device according to claim 1, wherein the torque and/or power transmission device is and/or comprises at least one articulated shaft.

3. The driving device according to claim 1, wherein the torque and/or power transmission device is and/or comprises at least one angular transmission.

4. The driving device according to claim 1, wherein the torque and/or power transmission device includes at least one clutch by which the uppercarriage drive is engaged and disengaged, wherein the clutch is arranged in the undercarriage.

5. The driving device according to claim 1, wherein the torque and/or power transmission device is driven directly by an auxiliary drive of the undercarriage engine.

6. The driving device according to claim 1, wherein the torque and/or power transmission device is driven by an auxiliary drive of a manual or automatic transmission.

7. The driving device according to claim 1, wherein the torque and/or power transmission device is driven by an auxiliary drive of a transfer gear.

8. The driving device according to claim 1, wherein the uppercarriage drive comprises at least one pump transfer gear.

9. The driving device according to claim 1, wherein torque, force and power transmission from the undercarriage engine to the uppercarriage drive exclusively is effected mechanically.

10. The driving device according to claim 1, wherein the undercarriage engine is a diesel engine, wherein a power of the undercarriage engine is dimensioned such that a power required for crane operation is provided by the undercarriage engine at a low engine speed, including a speed range above an idling speed up to about twice the idling speed.

11. The driving device according to claim 1, wherein on the uppercarriage or in a region of the uppercarriage an auxiliary engine is provided, by which the uppercarriage drive is driven.

12. A crane comprising:

a driving device, the driving device including an undercarriage and an uppercarriage, the undercarriage including an internal combustion engine mounted therein and at least one uppercarriage drive, wherein the uppercarriage drive is driven by at least one articulated vertical shaft coupled between the internal combustion engine and a pump transfer gear and traversing from the undercarriage to the uppercarriage.

13. The crane according to claim 12, further comprising at least one angular transmission coupled to one of the articulated vertical shafts and between the engine and the pump transfer gear.

14. The crane according to claim 13, further comprising at least one clutch by which the uppercarriage drive is engaged and disengaged, wherein the clutch is arranged in the undercarriage, coupled to one of the articulated vertical shafts between the engine and the pump transfer gear.

15. The crane according to claim 14, wherein torque, force and power transmission from the undercarriage engine to the uppercarriage drive exclusively is effected mechanically.

16. A driving device for a crane, comprising:

an undercarriage and an uppercarriage, the undercarriage including an internal combustion engine mounted therein and at least one uppercarriage drive, wherein the uppercarriage drive is driven by at least one articulated vertical shaft coupled between the internal combustion engine and a pump transfer gear and traversing from the undercarriage to the uppercarriage.

17. The driving device according to claim 16, further comprising at least one angular transmission coupled to one of the articulated vertical shafts and between the engine and the pump transfer gear.

18. The driving device according to claim 17, further comprising at least one clutch by which the uppercarriage drive is engaged and disengaged, wherein the clutch is arranged in the undercarriage, coupled to one of the articulated vertical shafts between the engine and the pump transfer gear.

19. The driving device according to claim 18, wherein torque, force and power transmission from the undercarriage engine to the uppercarriage drive exclusively is effected mechanically.

20. The driving device according to claim 18, wherein the undercarriage engine is a diesel engine, wherein a power of the undercarriage engine is dimensioned such that power required for crane operation is provided by the undercarriage engine at a low engine speed, including a speed range above an idling speed up to about twice the idling speed.

* * * * *